US005334179A

United States Patent [19]

Poli et al.

[11] Patent Number: 5,334,179

[45] Date of Patent: Aug. 2, 1994

[54] LATCHING PIERCING PIN FOR USE WITH FLUID VIALS OF VARYING SIZES

[75] Inventors: Robert G. Poli, Campbell; V. Stanton Thomas, Palo Alto, both of Calif.; Wayne F. Adolf, Mt. Prospect; William L. Rudzena, McHenry, both of Ill.

[73] Assignee: Abbott Laboratories, Abbott Park, Ill.

[21] Appl. No.: 961,758

[22] Filed: Oct. 16, 1992

[51] Int. Cl.[5] ..... A61J 1/00

[52] U.S. Cl. ..... 604/403; 604/411; 604/412

[58] Field of Search ..... 604/403, 411, 414, 415; 141/329, 330; 222/80, 81, 88

[56] References Cited

U.S. PATENT DOCUMENTS 3,580,423 5/1971 Gilman ..... 222/81
4,607,671 8/1986 Aalto et al. ..... 191/329
4,675,020 6/1987 McPhee ..... 604/414 X
4,997,430 3/1991 Van Der Heiden et al. ... 604/414 X

FOREIGN PATENT DOCUMENTS 2087849A 6/1982 United Kingdom ..... 222/81
WO86/01712 3/1986 World Int. Prop. O. ..... 604/411

*Primary Examiner*—Robert A. Hafer
*Assistant Examiner*—Sam Rimell
*Attorney, Agent, or Firm*—Harry G. Thibault; Robert E. Wexler

[57] ABSTRACT

A latching piercing pin useable to retain the pin and an associated fluid vial in latching relation. Latching members provided on the pin engage a peripheral lip provided on the end cap of the vial to maintain the latching relation between the pin and the vial. The pin is useable with vials and end caps of varying sizes, although larger end caps may require the mounting of a locking ring on the end cap of the vial to receive and engage the latching piercing pin.

7 Claims, 3 Drawing Sheets

LATCHING PIERCING PIN FOR USE WITH FLUID VIALS OF VARYING SIZES

FIELD OF THE INVENTION

The present invention relates to piercing pins generally and in particular an improved latching piercing pin for use with fluid vials of varying sizes.

BACKGROUND OF THE INVENTION

A variety of medical fluids are commonly administered intravascularly to a patient in the course of medical treatment. Such medical liquids can include for example, saline or a dextrose solution or other fluids for correcting body chemistry and balances or medical solutions prescribed for the treatment of disease, or anesthetic drugs used in preparing a patient for surgery and during surgery. These medical liquids are normally available commercially in aseptic containers having self-sealing caps of a resilient material adapted to be punctured by an appropriate instrument, such as a hypodermic needle for removing fluid contents for supply to the patient.

Infusion of medical liquids is normally carried out by use of a so called intravenous administration set, sometimes referred to as an I.V. set, which includes means for puncturing the self-sealing cap of the fluid container and means for guiding the fluid in a continuous regulated flow to a catheter inserted, for example, into the vein of the patient. Other known systems, for example, interpose a fluid delivery pumping cassette in the fluid line between the fluid vial and the patient. The fluid vial may contain typical intravenous solutions, such as saline or dextrose, or selected drugs in liquid form, for use in patient infusion; hence, the term "fluid vial" is used to describe the generic container of the present invention.

Integral to such system is the connection between the fluid vial or fluid container and the catheter, whether or not the intermediate device such as the fluid delivery cassette is incorporated into the system. Typically, the connection between the vial and the catheter is a spiked conduit insert having a spiked end inserted into the resilient cap of the fluid vial with an opposite end connected to fluid delivery means for delivering fluid through the catheter to the patient. A typical I.V. spike is shown in U.S. Pat. No. D. 268,698 or U.S. Pat. No. D. 297,262. The devices depicted in the above noted patents are relatively simple having a spike on one end, a conduit therethrough and an opening connectable to a catheter or associated fluid delivery device at the other. Such devices do not include means for latching the piercing pin to an associated fluid vial or typically if there is any positive connecting apparatus associated with such piercing pin, it is usually associated with the end opposite the piercing element, in the connection to the fluid line.

The fluid infusion system of U.S. Pat. No. 4,581,014 actually incorporates two piercing pins therein, but displays no real locking connection between the pin and the associated fluid vial into which the pin may be inserted.

SUMMARY OF THE INVENTION

Accordingly, it would be desirable to provide a latching piercing pin that includes positive latching means associated with the piercing pin to engage and latch the fluid vial.

Further, it would be desirable for such latching apparatus to be usable with fluid vials of varying sizes and having end caps of varying sizes.

Further, it would be desirable if the latching means were cooperable with stops associated with a device in which the fluid vial and piercing pin combination could be inserted for delivery of drugs or other medical fluids to a patient, thereby preventing removal of the fluid vial from such device. Further, it would be desirable if the proposed latching piercing pin were to include resilient means associated with the latching members to enable the piercing pin to grip vials having end caps of varying sizes and further include gripping means to enable the user to disengage the latch means associated with the piercing pin from the fluid vial selectively. Such a combination of fluid vial and I.V. set would also maintain a more aseptic connection between vial and I.V. set over an extended period of time and also allow easier handling of the vial/set combination. Also, easier handling of the vial/I.V. set combination could be achieved through use of the proposed latching pin with such combination. If such a latching pin is used, the vial could be moved without fear of breaking the connection between the vial and the I.V. set, thus to enable movement or transport of the vial/set combination by handling the vial only.

Accordingly, an improved piercing pin locking system is proposed wherein a piercing pin having a piercing element at one end, a fluid connector at the other end and a fluid conduit therebetween includes a latching apparatus comprising a flexible beam mounted on the main body portion of the piercing pin to extend transversely from a mid-portion of said body portion, with engaging members mounted on the flexible beam on opposite sides of the body portion and extending outwardly in the same direction as the piercing element, with each engaging member including at a respective upper end thereof and inwardly directed latching element for engagement with an associated fluid vial.

In the preferred embodiment the fluid vial includes a piercible member overlying an open end of the vial, with an end cap overlying and sealing the piercible member and having an upright peripheral wall engaging the outer surface of the vial, said peripheral wall terminating in a stepped peripheral lip forming a gripping surface.

In the preferred embodiment the piercing pin pierces the piercible membrane provided on the vial. As the pin travels into the vial, the engaging members travel along the outer wall of the sealing cap to enable latching members provided at the top of the engaging members to latch onto the peripheral step portion or lip of the sealing cap to hold vial and piercing pin in latched relation.

In an alternative embodiment of the present invention in which both vial and end cap are substantially larger than in the embodiment described above, a locking ring with a peripheral lip is mounted on the sealing cap, with the locking ring sliding along the ramped upper surface of each engaging member until such members are separated by the locking ring to reengage the cap above the locking ring in latching relationship therewith. In this alternate embodiment, the same latching pin is used; however, the resilient beam is deformed to be disposed oblique to the longitudinal axis of the piercing pin when the pin is latched onto the locking ring of the larger vial.

The improved latching piercing pin of the present invention as described above provides positive latching means adjacent the piercing element to positively latch the piercing element to a fluid vial or to latch the piercing pin to each of a plurality of fluid vials of various and different sizes and each having an end cap of varying depth and differing sizes. Further, such a piercing pin latching system can be incorporated in a drug delivery device which includes stop means to retain the latching members of the pin in fixed relation within the pumping device so as to preclude removal of the vial from such device.

Other features and advantages of the present invention will become more apparent upon reading of the detailed description which follows, particularly when such detailed description is considered in conjunction with the accompanying drawings briefly described below.

DETAILED DESCRIPTION

Figure 3:
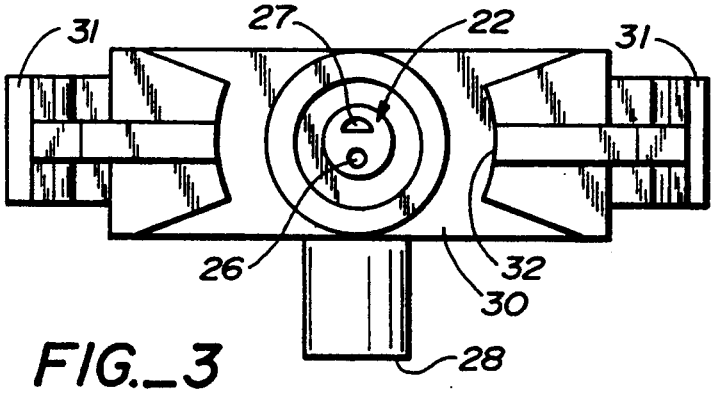
FIG. 3 is a top plan view of the latching piercing pin of FIG. 1.
Figure 1:
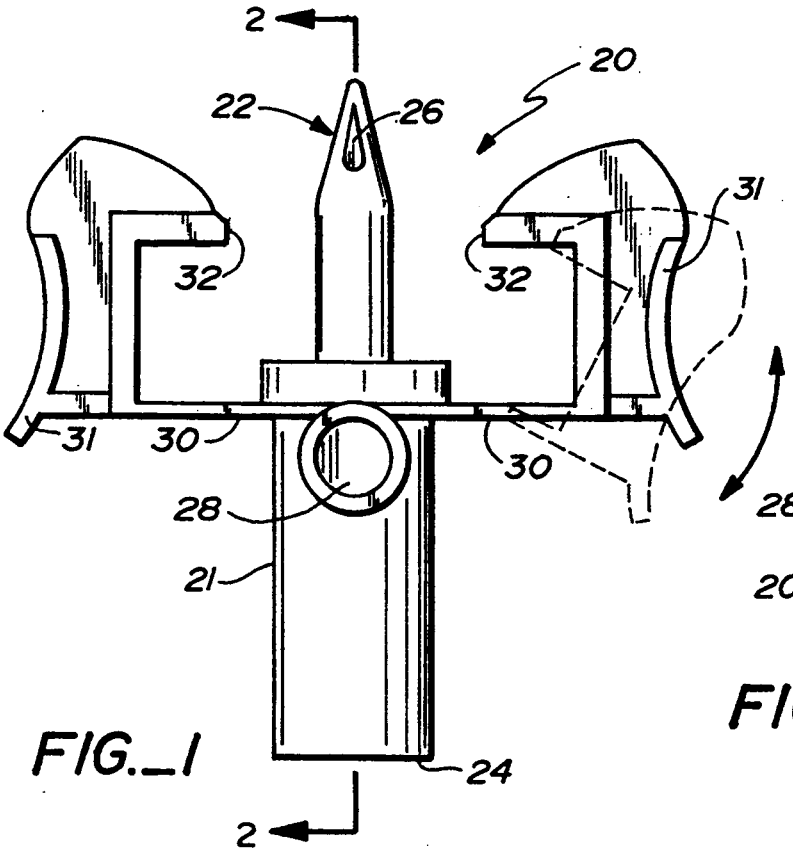
FIG. 1 is a front elevational view of the latching piercing pin of the present invention.
Figure 2:
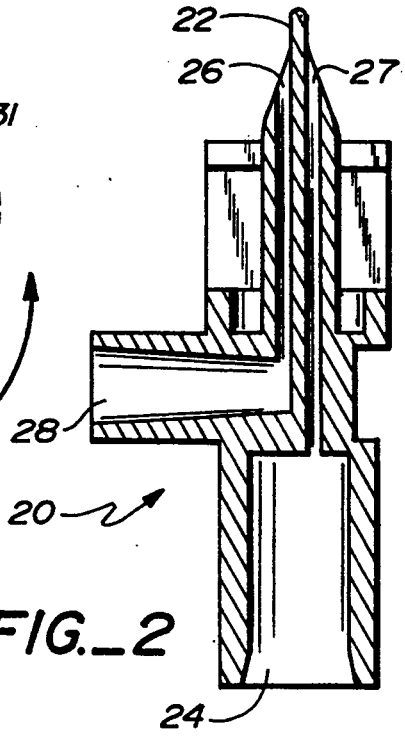
FIG. 2 is a sectional view taken generally along the lines 2—2 of FIG. 1.

As shown in FIGS. 1, 2 and 3, latching piercing pin 20 of the present invention comprises a longitudinal main body portion 21 having a vented spike 22 at one end and a connecting member 24 at an opposite end. The connecting member 24 is a fitment which allows connection of the latching piercing pin 20 to I.V. tubing, pumping cassette, fluid container, etc. As shown in FIG. 2, provided in the spike 22 is a fluid channel 26 communicating between the connecting member 28 and the spike 22, a second channel 27 provided in the spike 22 extends to a vent port 24. In the preferred embodiment, a flexible beam 30 extends outwardly and generally transversely from the main body 21 of the pin 20 to carry at outer ends thereof engaging members or arms 31, which carry at an upper end thereof latching members 32. As shown in FIG. 1 the flexible beam 30 lies at an upper end of the vent port 28 but the actual physical relationship between the beam 30 and the port 28 is of no significance to the present invention.

Figure 4:
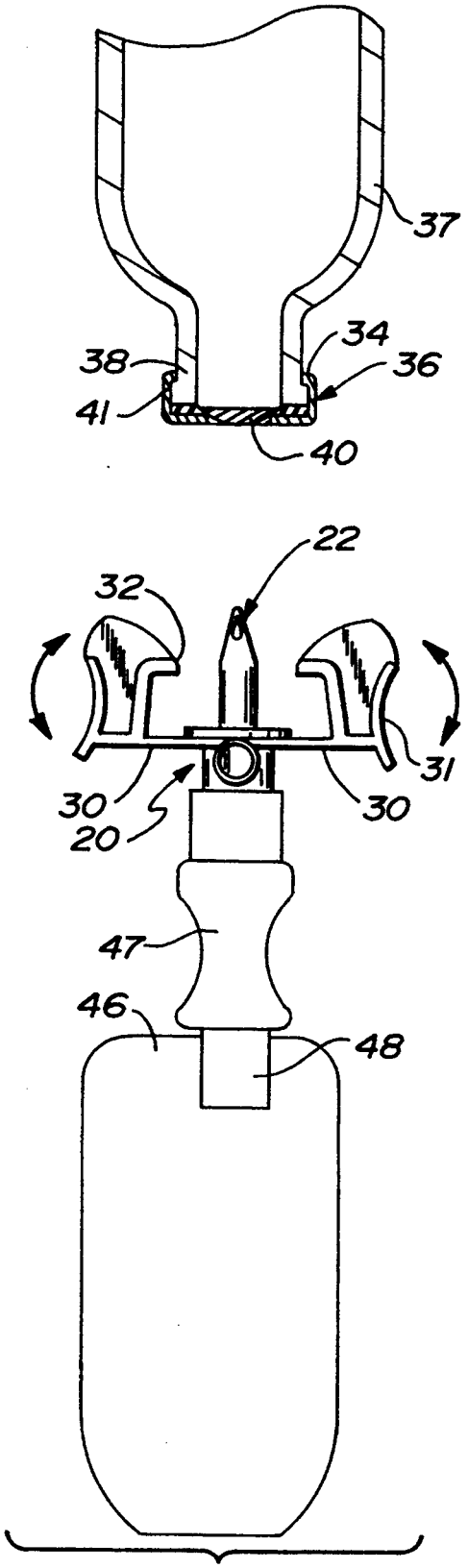
FIG. 4 is an exploded perspective view, partially in section, in which the latching piercing pin of the present invention is installed on a fluid delivery cassette, with the associated fluid vial disposed above.
Figure 5:
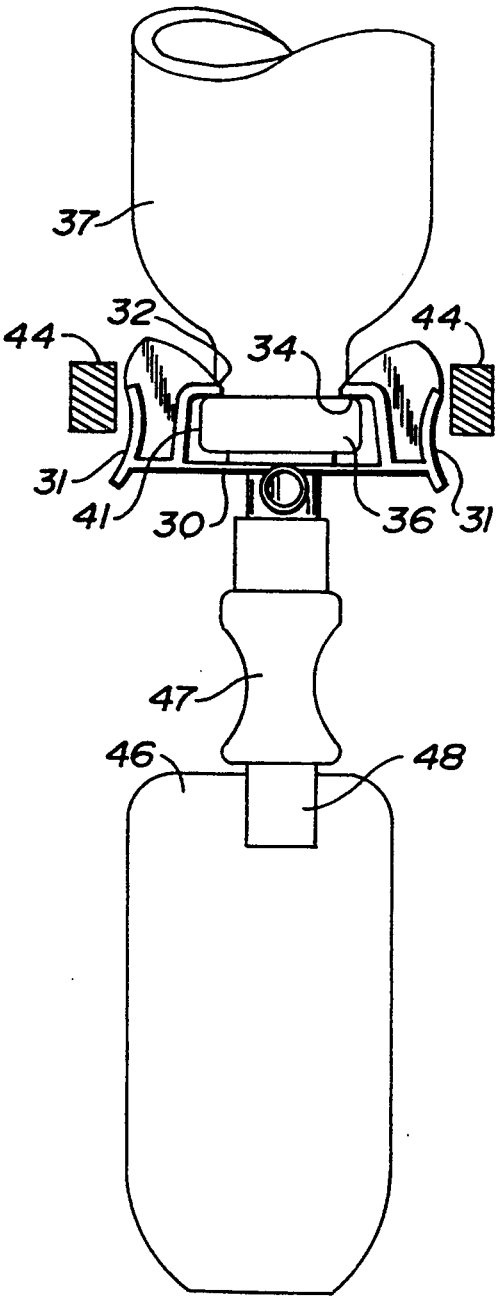
FIG. 5 is a view similar to FIG. 4 with the vial installed on the latching piercing pin and the combination of vial and piercing pin mounted between the stops of a drug delivery device, the stops engaging the arms of the latching piercing pin to retain the vial/pin combination in the drug delivery device.

However, as seen in FIGS. 4 and 5, the latching piercing pin 20 is used in combination with a fluid vial 37 and a fluid pumping cassette 46.

As seen in FIG. 4, the fluid vial 37 terminates in an end portion or collar 38 which receives a piercible flexible member or membrane 40 held in place by a rigid end cap 36. Outer wall 41 of the end cap 36 partially overlies the membrane 40 and extends upwardly therefrom along the collar 38 of the vial 37 to terminate at a stepped-in lip 34.

The pin 20 is shown mounted on a cassette 46 with a finger grip 47 interposed between the connector 24 (FIGS. 1–3) of the pin 20 and the cassette 46. Connector 48 is interposed between finger grip 47 and the cassette 46 in the preferred embodiment shown. In FIG. 4, the vial 37 is disposed above the pin 20 with vented spike 22 about to enter the piercible membrane 40 of the vial 37. As shown in FIG. 5, the engaging members or arms 31 of the pin 20 have traveled along opposite sides of the outer wall 41 of the end cap 36 to overlie and engage the peripheral lip 34 of the end cap 36 of the fluid vial 37 to retain the latching piercing pin 20 in latched relationship with the fluid vial 37 as shown in FIG. 5.

In a preferred embodiment of the present invention, the combination of the fluid vial 37, the latching piercing pin 20 and the cassette 46 may be disposed in a drug infusion device such as a pump (not shown), in which stops 44 are provided adjacent the engaging members 31 to retain latches 32 in engagement with the lip 34 of the vial 37 to retain the pin 20 on the vial 37 and to hold the combination of vial 37 and pin 20 within the drug infusion device and retained between the stops 44.

Figure 6:
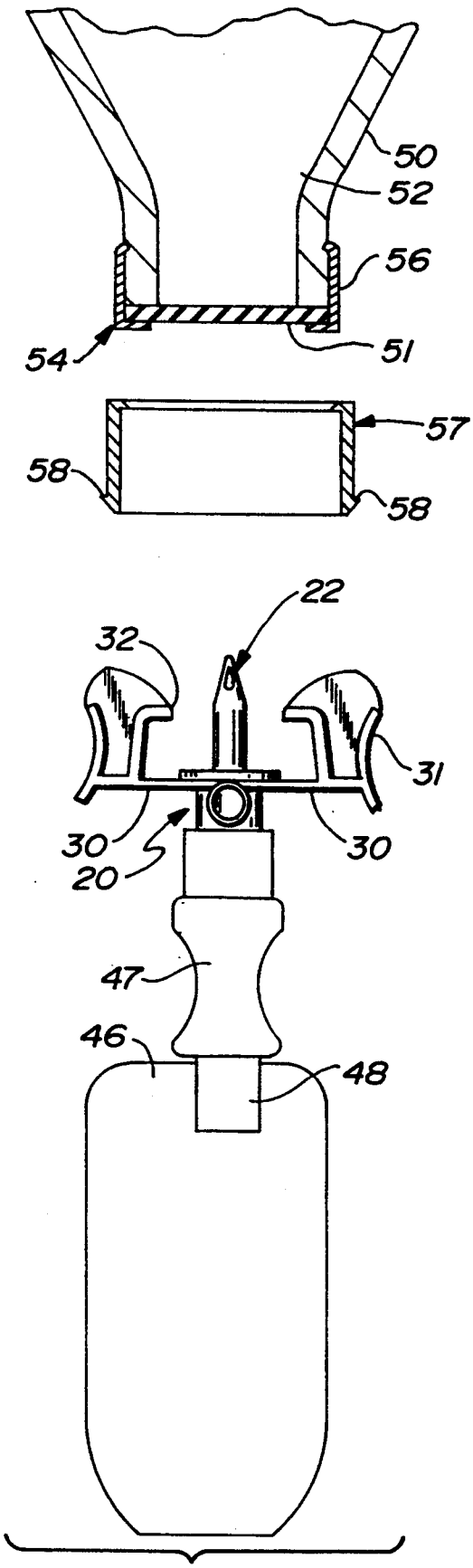
FIG. 6 is an exploded perspective view, partially in section and similar to FIG. 4, in which a larger vial, including a locking ring, is disposed above a latching piercing pin of the present invention in combination with an associated cassette.
Figure 7:
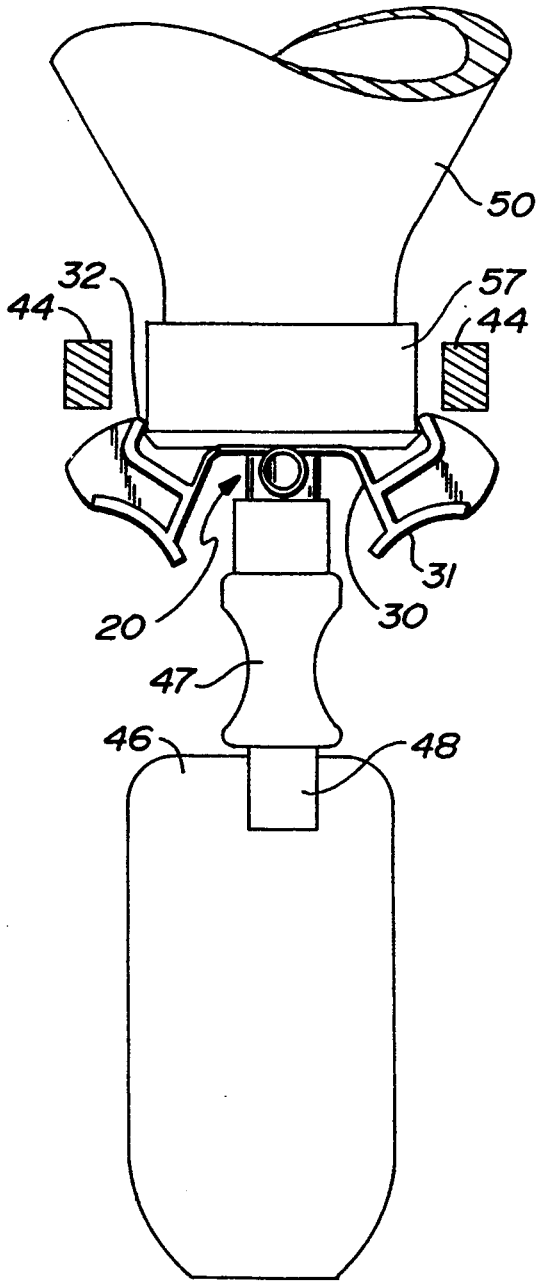
FIG. 7 is a view similar to FIG. 5 in which the larger fluid vial is mounted on the latching piercing pin with the latching members of the pin engaging a peripheral lip of the locking ring mounted on the vial.

In a second preferred embodiment shown in FIGS. 6 and 7, the latching piercing pin 20 and cassette 46 combination of FIGS. 4 and 5 is used with a substantially larger fluid vial 50 as shown in FIG. 6. The fluid vial 50 includes a resilient member 51 overlying the open end 52 of the vial 50 with a sealing cap 54 overlying the resilient member 51. While the relationship of the sealing cap 54 to the vial 50 is much the same as the relationship of the sealing cap 36 to the vial 37, because of the larger diameter of the sealing cap 54, if the latching piercing pin 20 were inserted into the resilient member 51 to engage and pierce the member 51 to provide access to the fluid within the fluid vial 50, the latching members 32 would merely slide up the wall 56 of the cap 54 and provide no locking action. Accordingly, a locking ring 57 including a peripheral lip 58 is mounted on the vial 50 to overlie the sealing cap 54 while still providing access to the resilient member 51 of the fluid vial 50.

Thus, as can be seen in FIG. 7, with the locking ring 57 in place, when the latching piercing pin 20 fully engages the vial 50 latching members 32 engage peripheral lip 58 of the locking ring 57 to retain the pin 20 on the vial 50 in latching relationship thereto. In FIG. 7 stops 44 of the drug infusion device are disposed above the latching pin 20 so as to have no effect on the retention of the latching pin in connection with the vial 50. However, the stops 44 can still prevent removal of the combination of the large vial 50, the pin 20, and the cassette 46 from the drug infusion device. Further note that the flexible beam 30 associated with the pin 20 is substantially deformed to actually extend obliquely and away from the bottom surface of the end cap 54 in the latched position of the pin 20 on the vial 50.

As can be seen from the detailed description here and provided, the latching piercing pin of the present invention provides a positive latching means for retaining the latching piercing pin in latched engagement with the fluid vial into which it is inserted. Furthermore, if used in a drug infusion device including appropriate stop means, the piercing pin can be so mounted therein as to engage stop means which would retain the vial in locked relationship with the device. Preferred embodiments of the invention have been illustrated and described, it will be appreciated that various changes can be made therein without departing from the spirit and scope of the invention.

The scope of the invention is indicated by the appended claims rather than the foregoing description, and all changes that come within the meaning and range of equivalents thereof are intended to be embraced therein.

We claim:

1. A latching piercing pin comprising:

a longitudinal body portion having opposite ends, with a piercing element at one end, a connecting member at an opposite and a fluid channel extending the length of said body portion, and in fluid communication with said opposite ends, a second vent channel and a vent port, the second channel extending from the piercing end to the vent port;

a flexible beam mounted on said body portion to extend transversely from a mid-portion of said body portion, said beam bendable about a longitudinal axis of the piercing pin substantially in excess of 45° from the transverse initial position thereof;

engaging members mounted on said flexible beam on opposite sides of said body portion and extending outwardly in the same direction as the piercing element and each member including at respective upper end thereof an latching member having an inwardly directed latching flange and an outwardly directed gripping flange, the pin operable to engage and pierce an associated fluid vial cooperable therewith, and the flexible beam moveable to substantially bend about the longitudinal axis of the pin to accept within the beam structure fluid vial covers for rigid walled vials of substantially varying sizes and the latching members are moveable in combination with said beam to engage and latch to said vial cover and gripping flanges operable to enable selective disengagement of the latching pin from the cover of an engaged fluid vial thereby implementing removal of the pin from the cover of the fluid vial.

2. A piercing pin locking system comprising a latching piercing pin and a fluid vial associated therewith, said locking system including a piercing pin having a longitudinal body portion with opposite ends, with a piercing element at one end, a connecting member at an opposite end and a fluid channel extending the length of said body portion, and in fluid communication with said opposite ends;

a flexible beam mounted to extend transversely from a mid-portion of said body portion;

engaging members mounted on said flexible beam on opposite sides of said body portion and extending outwardly in the same direction as the piercing element and each including at a respective upper end thereof an inwardly directed latching member, said engaging members biased to a latching position wherein the engaging members are generally parallel to a longitudinal axis of the piercing pin and the latching members overlie the peripheral lip of an end cap of an associated fluid vial;

said fluid vial including a piercible member overlying an open end of the vial, an end cap overlying and sealing the piercible member, the end cap including an upright peripheral wall engaging the vial and having an inwardly stepped peripheral lip providing a gripping surface for the latching members of the pin, the end cap of the fluid vial sufficiently large to distend the engaging members away from the longitudinal axis of the piercing pin, the fluid vial including a locking ring mountable on the end cap thereof, the locking ring including a peripheral lip engageable with the latching members of the locking pin the pin to pierce the piercible member of the vial and engage and latch the pin to the vial with the engagement of the latching members with the stepped peripheral lip of the end cap closing the open end of the vial, the engaging members and the flexible beam, moveable in combination to enable the pin to engage and latch to vial end caps and gripping surfaces of varying sizes, and the locking ring to retain the latching piercing pin on the locking cap and the associated fluid vial in latched relation.

3. A piercing pin locking system as claimed in claim 2 including gripping members associated with said engaging members to enable disengagement of latching members from the fluid vial, thereby implementing removal of the pin from the fluid vial.

4. A piercing pin locking system comprising a latching piercing pin and a fluid vial associated therewith, said locking system including;

a piercing pin having a longitudinal body portion with opposite ends, with a piercing element at one end, a connecting member at an opposite end, a fluid channel extending the length of said body portion, and in fluid communication with said opposite ends a second vent channel and a vent port, with the second channel extending from the piercing end to the vent port;

a flexible beam mounted to extend transversely from a mid-portion of said body portion;

engaging members mounted on said flexible beam on opposite sides of said body portion and extending outwardly in the same direction as the piercing element and each including at a respective upper end thereof an inwardly directed latching member, a fluid vial including a piercible member overlying an open end of the vial, an end cap overlying and sealing the piercible member, the end cap including an upright peripheral wall engaging the vial and having an inwardly stepped peripheral lip providing a gripping surface for the latching members of the pin; the pin to pierce the piercible member of the vial and engage and latch the pin to the vial with the engagement of the latching members with the stepped peripheral lip of the end cap closing the open end of the vial, the engaging members and the flexible beam, moveable in combination to enable the pin to engage and latch to vial end caps and gripping surfaces of varying sizes.

5. A piercing pin locking system comprising a latching piercing pin and a fluid vial associated therewith, said locking system including:

a piercing pin having a longitudinal body portion with opposite ends, with a piercing element at one end, a connecting member at an opposite end a fluid channel extending the length of said body portion, and in fluid communication with said opposite ends;

a flexible beam mounted to extend transversely from a mid-portion of said body portion;

engaging members mounted on said flexible beam on opposite sides of said body portion and extending outwardly in the same direction as the piercing element and each including at a respective upper end thereof an inwardly directed latching member, a fluid vial including a piercible member overlying an open end of the vial, an end cap overlying and sealing the piercible member, the end cap including an upright peripheral wall engaging the vial and having an inwardly stepped peripheral lip providing a gripping surface for the latching members of the pin;

stop means of a drug infusion device for receiving the fluid vial and piercing pin in combination;

the pin to pierce the piercible member of the vial and engage and latch the pin to the vial with the engagement of the latching members with the stepped peripheral lip of the end cap closing the open end of the vial, the engaging members and the flexible beam, moveable in combination to enable the pin to engage and latch to vial end caps and gripping surfaces of varying sizes, and said stop means aligned to engage the opposite engaging members of the piercing pin so as to retain the piercing pin in a latched position within the device, thereby to prevent removal of the fluid vial and latching piercing pin from the device.

6. A latching piercing pin comprising:

a longitudinal body portion having opposite ends, with a piercing element at one end, a connecting member at an opposite and a fluid channel extending the length of said body portion, and in fluid communication said opposite ends, a second vent channel and a vent port, with the second channel extending from the piercing end to the vent port;

a flexible beam mounted on said body portion to extend transversely from a mid-portion of said body portion;

engaging members mounted on said flexible beam on opposite sides of said body portion and extending outwardly in the same direction as the piercing element and each including at respective upper end thereof an inwardly directed latching member, the pin operable to pierce, engage and latch an associated fluid vial cooperable therewith, and the flexible beam and engaging members are moveable in combination to engage and latch to vials of varying sizes.

7. A latching piercing pin as claimed in claim 6 including gripping members associated with said engaging members to enable selective disengagement of the latching members from the fluid vial thereby implementing removal of the pin from the fluid vial.

* * * * *